US006098342A

United States Patent [19]

Bischof et al.

[11] Patent Number: 6,098,342

[45] Date of Patent: Aug. 8, 2000

[54] MOVABLE PARTITION SYSTEM HAVING A RAIL, AND A RAIL FOR A CARRIAGE FOR A MOVABLE PARTITION, AND A METHOD FOR USE OF A MOVABLE PARTITION SYSTEM HAVING A RAIL

[75] Inventors: Markus Bischof, Altenrhein; Stefan Rechsteiner, Staad, both of Switzerland

[73] Assignee: Dorma GmbH + Co. KG, Ennepetal, Germany

[21] Appl. No.: 09/335,611

[22] Filed: Jun. 18, 1999

Related U.S. Application Data

[63] Continuation-in-part of application No. PCT/EP98/06466, Oct. 12, 1998.

[30] Foreign Application Priority Data

Oct. 20, 1997 [DE] Germany ..... 197 46 208

[51] Int. Cl.[7] ..... E05D 13/00

[52] U.S. Cl. ..... 49/409; 49/506

[58] Field of Search ..... 49/125, 127, 128, 49/409, 453, 454, 456, 457, 506

[56] References Cited

U.S. PATENT DOCUMENTS

| | | | |
|---|---|---|---|
| 4,651,469 | 3/1987 | Ngian et al. | 49/409 X |
| 4,775,127 | 10/1988 | Nakamura | 49/409 X |
| 4,854,078 | 8/1989 | DePrima | 49/409 |

FOREIGN PATENT DOCUMENTS 4041925 3/1992 Germany .

*Primary Examiner*—Jerry Redman
*Attorney, Agent, or Firm*—Nils H. Ljungman & Associates

[57] ABSTRACT

A runner or guide rail for a running mechanism for suspension-mounted dividing walls or partitions. The runner or guide rail is configured as a box-shaped hollow section comprising two U-shaped sections with their U-limbs pointing towards each other. A part of the runner or guide rail is detachable in order to create an inspection opening. This detachable part of the runner rail comprises a web of a U-section and a corresponding U-limb, said U-limb delimiting the guiding slot which a supporting member fits through.

20 Claims, 10 Drawing Sheets

MOVABLE PARTITION SYSTEM HAVING A RAIL, AND A RAIL FOR A CARRIAGE FOR A MOVABLE PARTITION, AND A METHOD FOR USE OF A MOVABLE PARTITION SYSTEM HAVING A RAIL

CONTINUING APPLICATION DATA

This application is a Continuation-In-Part application of International Patent Application No. PCT/EP98/06466, filed on Oct. 12, 1998, which claims priority from Federal Republic of Germany Patent Application No. 197 46 208.1, filed on Oct. 20, 1997. International Application No. PCT/EP98/06466 was pending as of the filing date of the above-cited application. The United States was an elected state in International Application No. PCT/EP98/06466.

BACKGROUND OF THE INVENTION

1. Field of the Invention

The present invention relates to a guide rail for a carriage with a suspended partition or similar object that hangs from the carriage. The rail has a hollow box-shaped section with a guide slot for the passage of a support element that is connected with the partition, and the hollow section includes U-shaped sections oriented in mirror symmetry to each other on either side of the guide slot. The U-webs of the sections form the outer boundary of the hollow section and the U-legs of the sections point toward one another so that two facing U-legs define a connection section for the connection of the rail to a ceiling structure or similar structure, and two facing U-legs border the guide slot.

2. Background Information

German Patent No. 40 41 925 C1 describes a rail of the type described above, in which a carriage designated as a support and guide element is guided in the rail, which carriage consists essentially of a square support roller receptacle that has support rollers on each side, so that the support rollers of the support and guide elements run on the bearing surfaces of the two facing U-legs that define the guide slot.

The object of a project developed internally by the applicant is also a rail of the type described above, in which the individual partition is suspended on two carriages that are at some distance from one another, whereby each carriage has at least one support roller, whereby the support roller of the one carriage is supported on the bearing surface of the one U-leg that borders the guide slot, and an additional support roller of the other carriage is supported on the bearing surface of the other, facing U-leg that borders the guide slot.

One feature that the rails described above have in common is that they surround the carriage—with the exception of the guide slot necessary for the passage of the support element for the partition—on all sides. For purposes of inspection and repair, however, it is desirable to have access to the carriage without having to disconnect the entire train of partitions or to remove a number of partitions.

One potential solution to this problem is disclosed by the applicants' "HSW-G Installation Instructions," which instructions are included hereinbelow, and which refer to a guide rail as disclosed in the above mentioned German Patent No. 40 41 925 C1. In this case, as illustrated in Step 8 (see FIG. 9) of the installation instructions, there is an inspection piece that can be detached from the guide rail. The above mentioned inspection piece essentially consists of a complete partial segment of the rail, and can be removed from the rail after detachment from the ceiling structure. For centering between the inspection piece and the adjacent rail segments, there are guide grooves in the adjacent rail segments and matching guide tabs on the inspection piece that fit into the guide grooves. The guide grooves and the guide tabs are located in the vicinity of the connection to the ceiling structure. In practice, it has been found that even small misalignments of the inspection piece with respect to the adjacent rail segments can lead to disruptions when the carriage passes through the inspection piece. Since, as specified in the above referenced installation instructions, the rail that forms a guide channel for the carriage must be completely opened when the inspection piece is removed, it is necessary to jack up or to otherwise support the partition on the floor side when the carriage is moved into the vicinity of the inspection opening for inspection or repair, because, in this area, there is no longer any guidance for the support rollers of the carriage.

OBJECT OF THE INVENTION

The object of the present invention is to realize a rail of the type described above so that it is possible to inspect or repair the carriage without essentially eliminating the support function of the support rollers, and so that the creation of a suitable inspection opening or an inspection hatch or closure does not adversely affect the guide characteristics of the rails in the vicinity of the inspection opening or of the inspection hatch or closure or part.

SUMMARY OF THE INVENTION

The present invention teaches that this object can be accomplished with a guide rail for a carriage with a suspended partition or similar object that hangs from the carriage. The rail can have a web and a U-leg of a U-section that is associated with the web, which U-leg borders the guide slot, and can be detachably connected with the guide rail over a portion of the length of said guide rail. The present invention also teaches that a web of the rail and a U-leg of a U-section that is associated with the web and that borders the guide slot can be detachably connected to the U-leg by means of a partial length of the rail. That means that regardless of whether the individual carriage with two support rollers is guided in both U-sections or only with one support roller in one U-section, each of the U-sections can be detached so that a support roller of the carriage is always accessible from one side. When a carriage that has two support rollers as described in DE 40 41 925 C1 is used, one of the two support rollers always retains its support function. When only one support roller per carriage is used, the inspection opening can be placed so that it is located on the side of the rail opposite the support roller, so that the support roller bearing is accessible. Because the rail is also essentially not fully interrupted or broken, the guide characteristics of the rail can be preserved, and the misalignment of neighboring segments of the rail caused by the inspection piece of the prior art can be essentially eliminated.

Additional characteristics of the invention are described in the features hereinbelow.

The present invention teaches that it can be advantageous to connect to each other the two facing U-legs that form a connection section for the connection of the rails to a ceiling structure or a similar structure, in other words, to realize the inspection piece, in at least one embodiment of the present invention, so that it essentially includes only one U-web and one U-leg that defines the guide slot.

In one advantageous possible installation for the inspection piece, the web of the U-section can have undercut grooves on the outer surface of the web, preferably a plurality of which are located so that they extend over the height of the web. In this case, the web of the inspection piece can be fastened with the use of an external tab that is in contact with the outer surface of the web of the inspection piece and the outer surface of the web of the adjacent U-shaped section, and can be detachably connected to the web of the adjacent U-shaped section. This detachable connection can preferably be made by screws that run through the outer tab and are engaged in inside tabs located in the undercut grooves of the web of the inspection piece and of the web of the adjacent U-shaped section. The inspection piece may also be mounted by means of hammer-head bolts or T-head bolts that extend through the outer tab and are secured with their heads in the undercut grooves of the web of the inspection piece and of the web of the adjacent U-shaped section. In each case, the inspection piece, formed essentially by the web of the U-shaped section and the leg of the U-shaped section that borders the guide slot, can be fastened to the adjacent part of the rail so that a properly aligned guidance of the carriage is essentially guaranteed.

The U-leg that borders the guide slot can form, in a known manner, the bearing surface for the support roller. If this bearing surface is formed by wear plates or wear inserts, in one possible configuration of the present invention, the butt joints of the wear plates or wear inserts can be offset with respect to the butt joints between the U-legs of the inspection piece and the U-legs of the adjacent U-shaped section, whereby this offsetting can be preferably done so that the wear plates or wear inserts of the U-leg adjacent to the inspection piece project beyond the butt joint of the U-leg, i.e. they project into the vicinity of the inspection opening. Because the wear plates are made of hardened material and are mounted in guides of the above-referenced U-legs, in this case there can be additional centering between the detachable inspection piece and the adjacent segment of the rail.

In practice, at least two inspection openings located in substantially mirror symmetry to each other and offset in the longitudinal direction of the rail can be located along the length of the rail, so that each carriage may be accessible from each side.

Consequently, the present invention can create a rail that makes it possible to inspect and repair partitions that are suspended from a carriage, without essentially any loss of the guidance characteristics of the rail, and without essentially eliminating the supporting function of the carriage in the vicinity of the inspection opening.

The above discussed embodiments of the present invention will be described further hereinbelow with reference to the accompanying figures. When the word "invention" is used in this specification, the word "invention" includes "inventions," that is, the plural of "invention." By stating "invention," the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to one exemplary embodiment of an automatically movable partition system that is illustrated schematically in the accompanying drawings, in which.

DESCRIPTION OF THE PREFERRED EMBODIMENT

Figure 1:
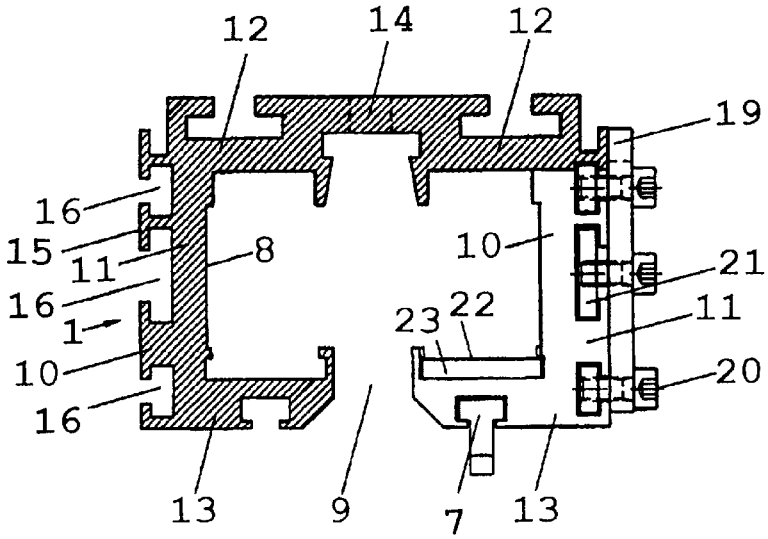
FIG. 1 is a cross section through the rail in the vicinity of the inspection opening.

The cross section in FIG. 1 shows a rail or guide rail 1 in the vicinity of an inspection piece 17 (see FIG. 2), in which rail a carriage 2 (see FIG. 4) is guided. The carriage 2 essentially has a support roller 3, guide rollers 4 and a support element 5 for fastening to a partition (not shown).

Figure 2:
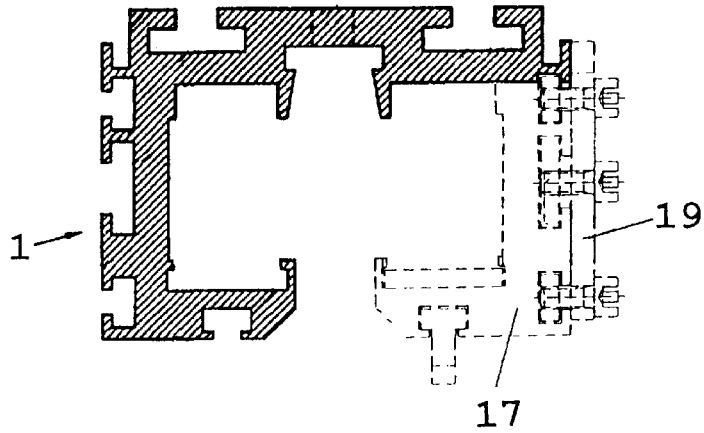
FIG. 2 is the cross section shown in FIG. 1 with the inspection piece illustrated in broken lines.
Figure 4:
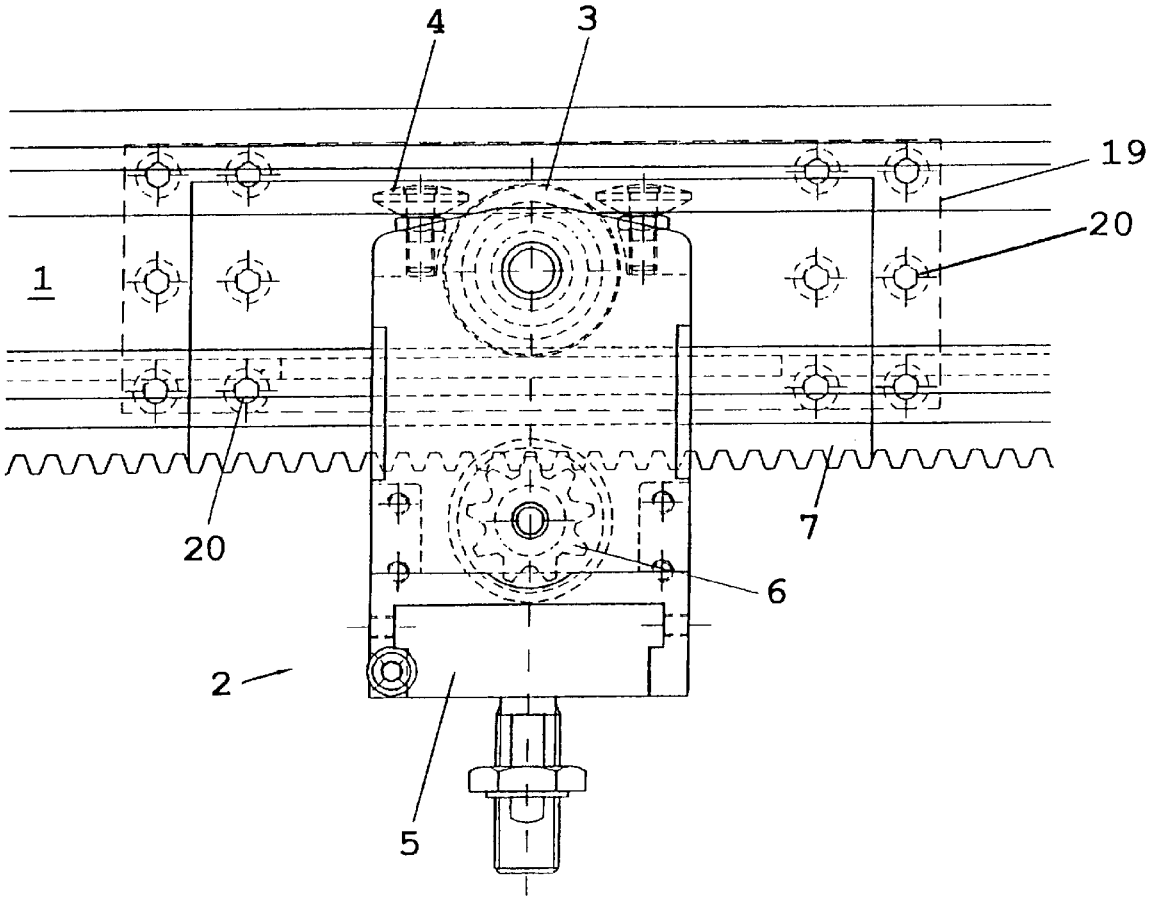
FIG. 4 is a side view of the rail with the inspection piece in place.

FIGS. 2 and 4 also show a drive pinion 6 associated with the carriage 2, which drive pinion is engaged with a toothed rack 7.

As also shown in FIGS. 1 and 2, the rail 1 comprises a box-shaped hollow section 8 that has a guide slot 9. The box-shaped hollow section 8 is formed essentially by two U-shaped sections 10, U-webs 11 of which form the outer limit of the hollow section 8 and U-legs 12 of which point toward one another. The upper, facing U-legs 12 in the plane of FIGS. 1 and 2 are connected to each other in one piece and thus form a connecting section 14 for connection to a ceiling structure 32 (see FIG. 6).

Outer web surfaces 15 of the U-webs 11 have undercut grooves 16, a plurality of which can be located one above the other.

Figure 3:
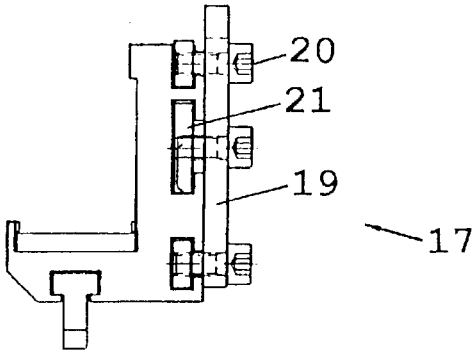
FIG. 3 is a cross section through the inspection piece.

The inspection piece 17 is illustrated in the broken lines in FIG. 2, and in solid lines in FIG. 3. In at least one embodiment of the present invention, the inspection piece 17 can consist essentially of one of the two U-webs 11 and a corresponding one of the two facing U-legs 13 bordering the guide slot 9. The connection of the inspection piece 17 with the adjacent areas of the guide rail 1 is accomplished by an outer tab 19 (see FIG. 4), through which screws 20 are introduced. In the exemplary embodiment illustrated, the screws 20 are engaged in inner tabs 21 which are mounted in the undercut grooves 16. The U-legs 13 form a bearing surface 22 for the bearing roller 3, and have a wear plate or insert 23, on which the support roller 3 runs.

Figure 5:
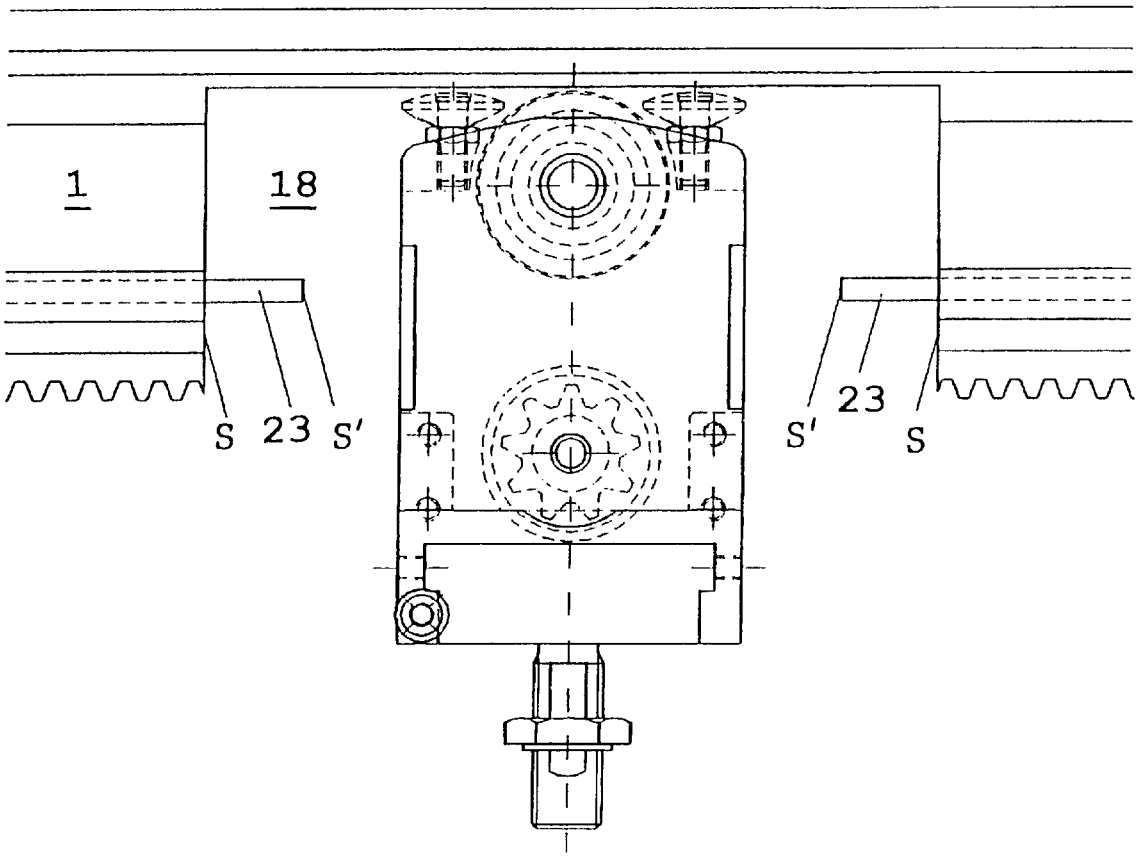
FIG. 5 is a side view as shown in FIG. 4, with the inspection piece removed.

FIG. 5 shows that butt joints S' of wear plates 23 are offset with respect to butt joints S of the U-legs 13, so that the wear plates 23 project into inspection opening 18 to provide an additional centering between the inspection piece 17 and the adjacent segments of the rail 1.

As shown in FIG. 4, the width of the tab 19 is greater than the width of the inspection opening 18 (see FIG. 5), so that the tab 19 can be bolted on one hand to the inspection piece 17 and on the other hand to the adjacent area of the guide rail 1. In the vicinity of the inspection piece 17, the toothed rack 7, which is necessary for the drive mechanism in automatic systems, is also split so that the entire inspection piece 17, including the toothed rack or rod 7, can be removed after detaching the strip or tab 19 from the guide rail 1. The realization of a guide rail 1 with an inspection piece 17 can be used on both automatic and manual partition systems.

In another possible embodiment of the present invention, in place of the toothed rack 7, a substantially smooth guiding surface structure or friction surface structure could possibly be used. In place of the drive pinion 6, a friction wheel or similar device could also possibly be used to engage with the guiding surface or friction surface. The guiding or friction surface structure can also be split or segmented so that the entire inspection piece 17, including the surface structure portion, can be removed after detaching the strip or tab 19 from the guide rail 1.

Figure 6:
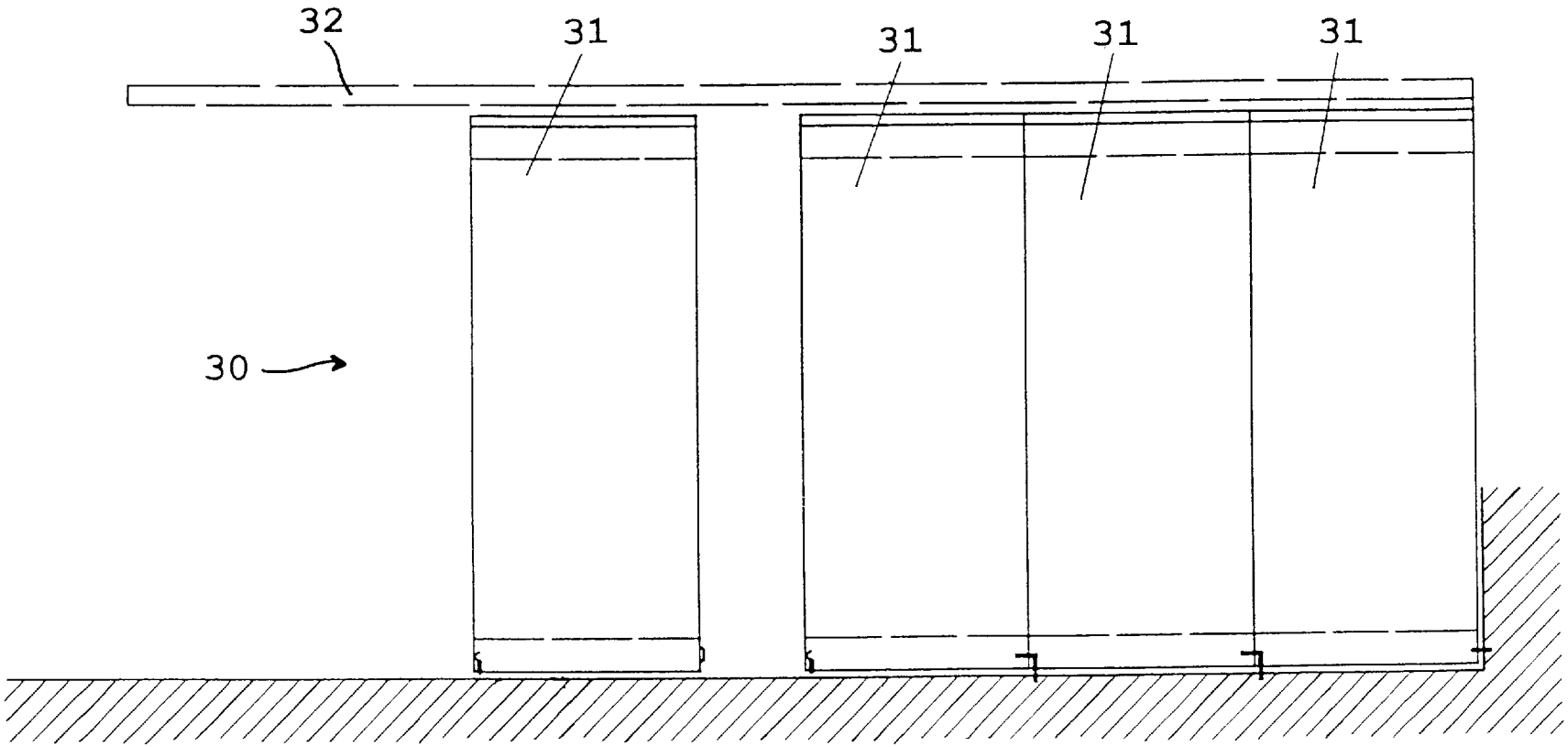
FIG. 6 shows one possible embodiment of the present invention having a movable partition system with partition elements.
Figure 7:
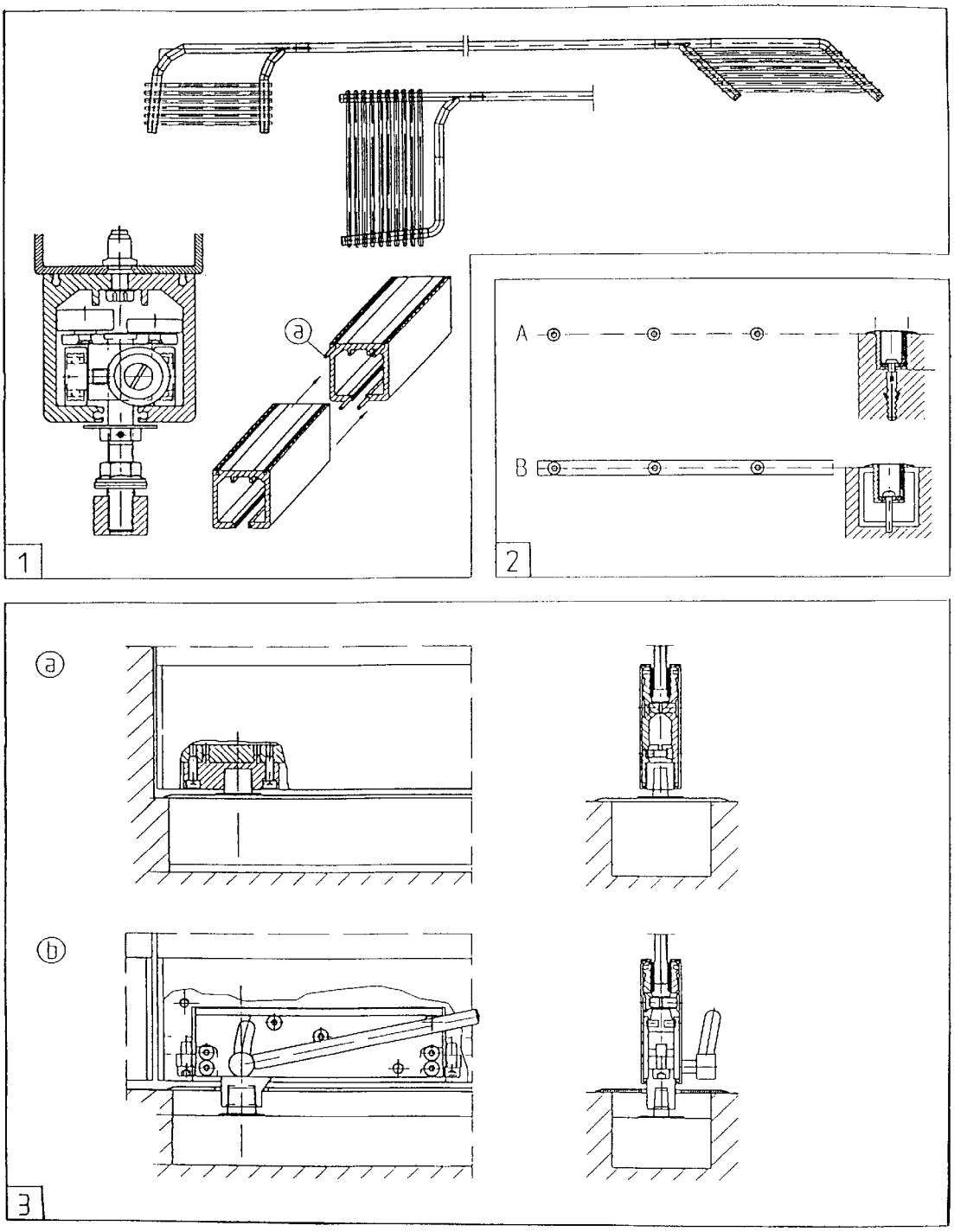
FIG. 7 shows installation steps 1–3 of the "HSW-G Installation Instructions"
Figure 8:
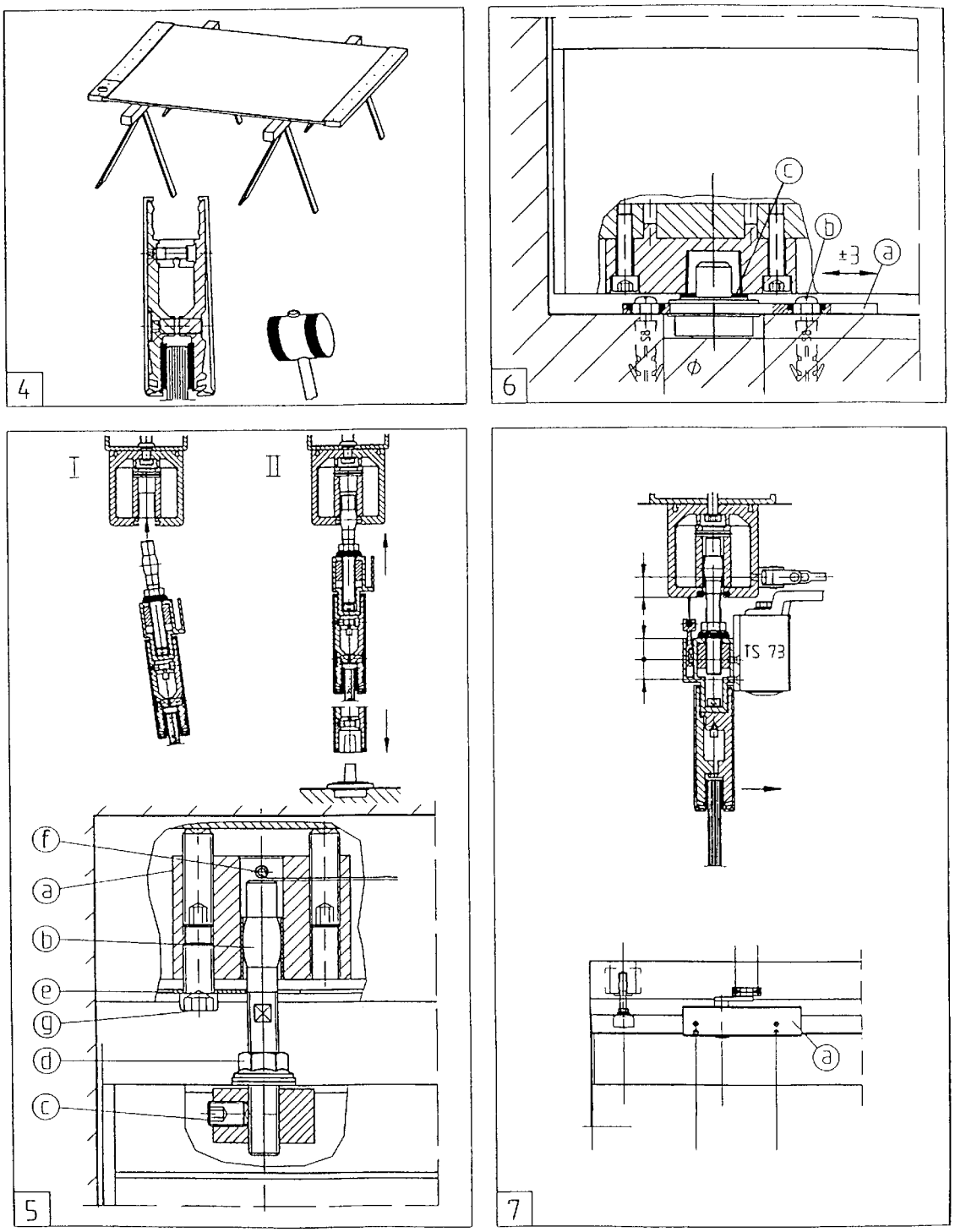
FIG. 8 shows installation steps 4–7 of the "HSW-G Installation Instructions"
Figure 9:
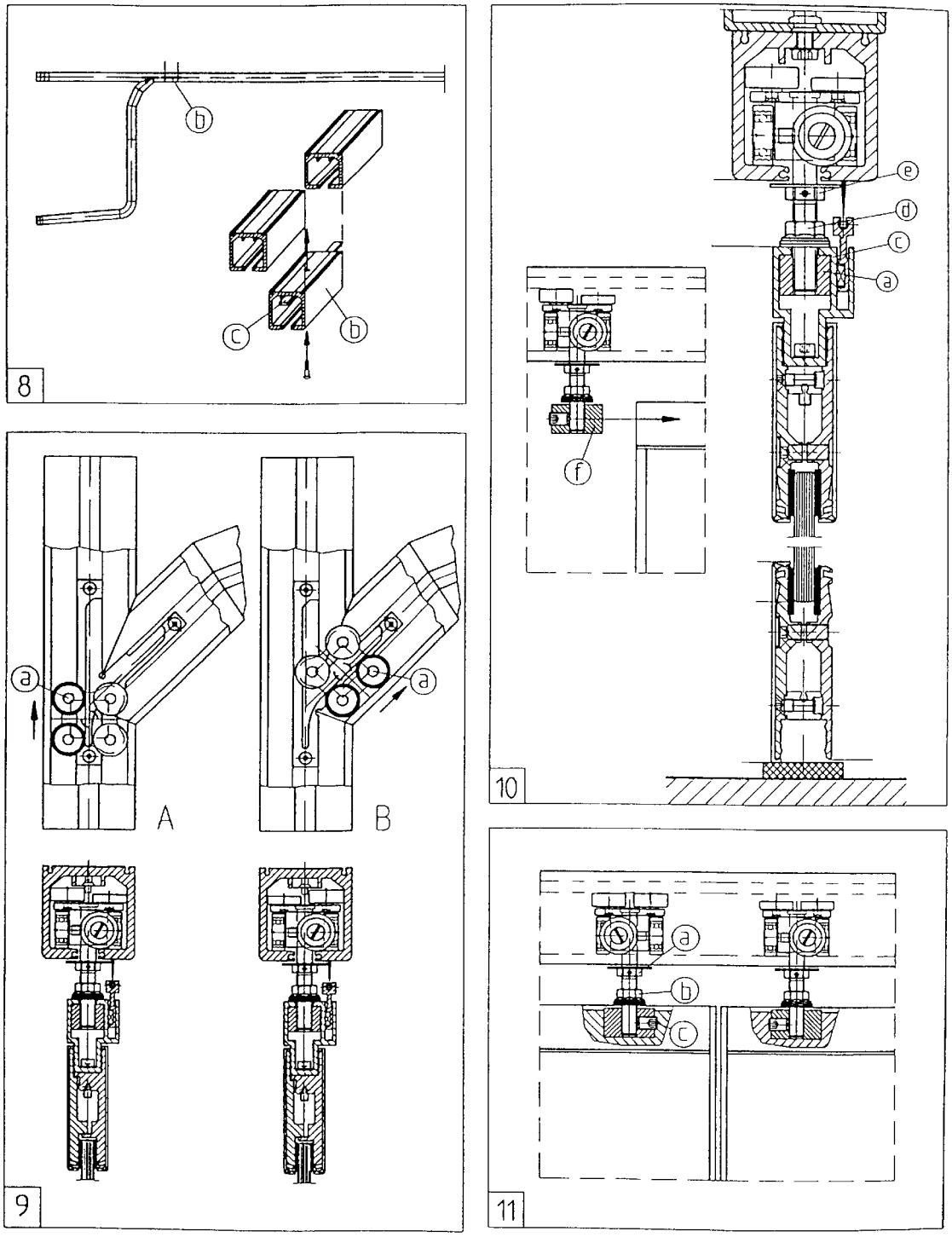
FIG. 9 shows installation steps 8–11 of the "HSW-G Installation Instructions"
Figure 10:
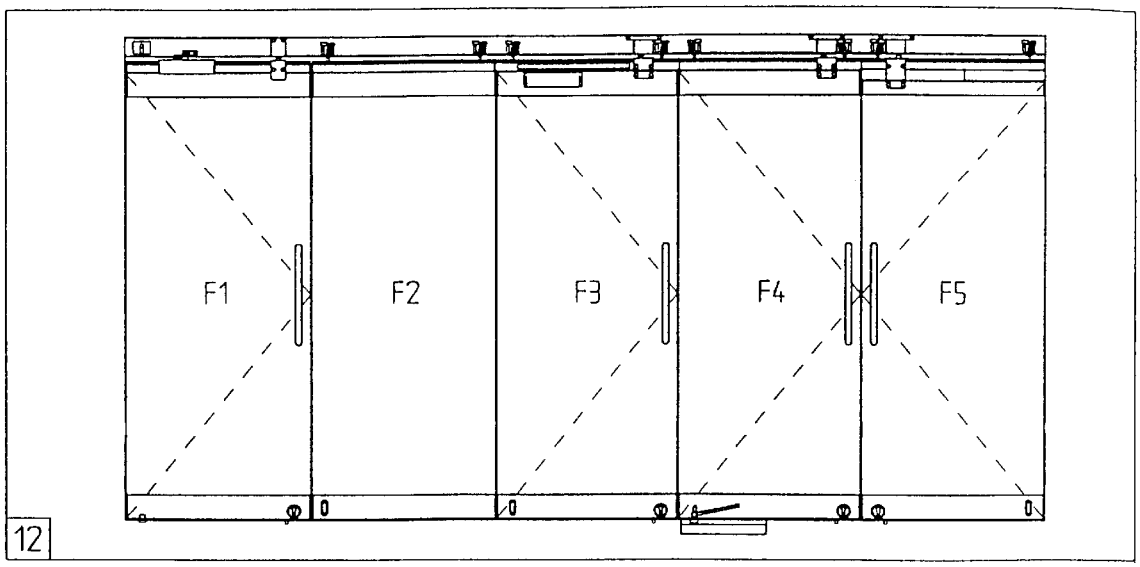
FIG. 10 shows installation steps 12–13 of the "HSW-G Installation Instructions"
Figure 10:
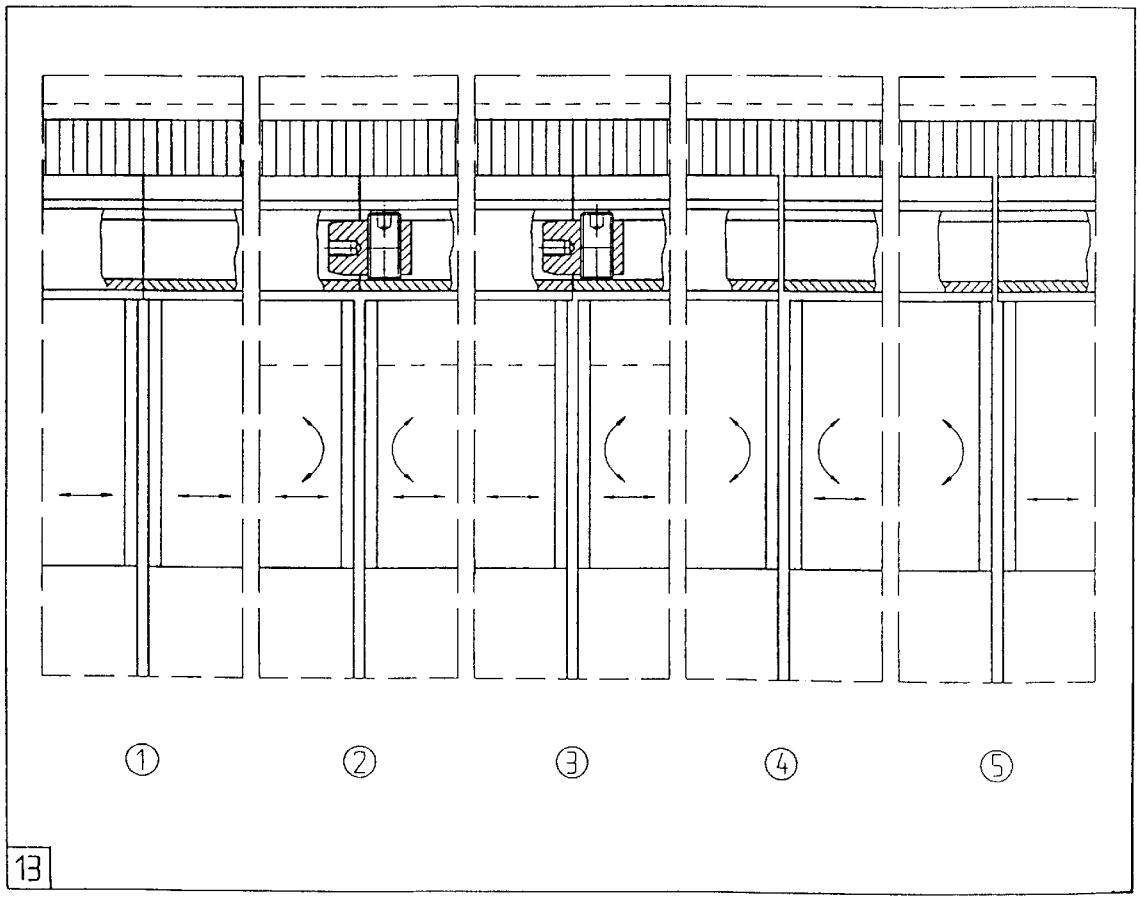
Figure 11:
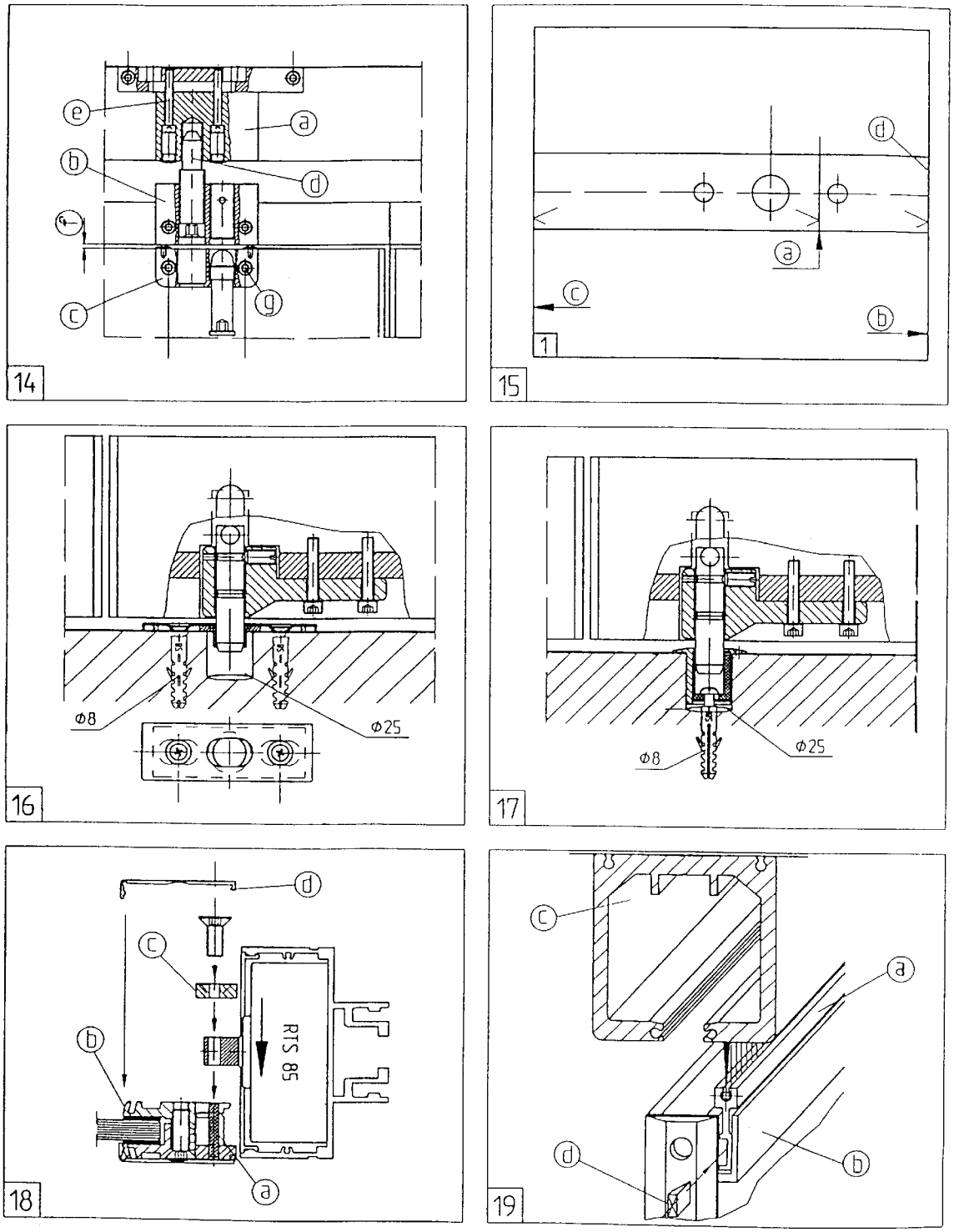
FIG. 11 shows installation steps 14–19 of the "HSW-G Installation Instructions"
Figure 12:
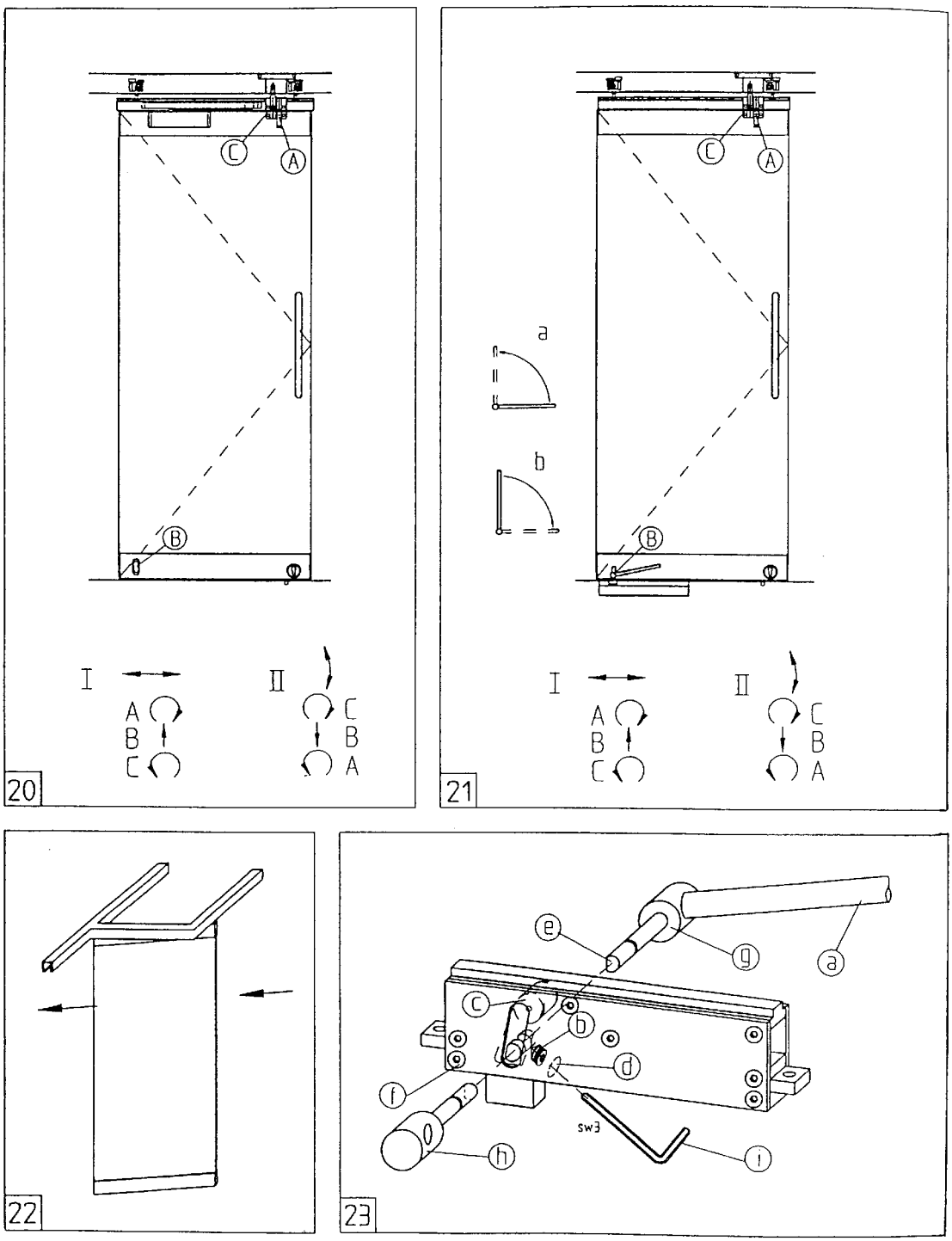
FIG. 12 shows installation steps 20–23 of the "HSW-G Installation Instructions".

FIG. 6 shows one possible embodiment of a movable wall or movable partition system in which the present invention could be used. A movable wall or movable partition system 30 is shown, which system can have hanging movable wall or movable partition elements 31. The hanging movable wall elements 31 can be hung from a corresponding support element 5 (as shown in FIG. 4) adjacent the ceiling area 32.

One feature of the invention resides broadly in the guide rail for a carriage with a suspended partition or similar object that hangs from the carriage, whereby the rail has a hollow box-shaped section with a guide slot for the passage of a support element that is connected with the partition, and the hollow section consists of U-shaped sections oriented in mirror symmetry to each other on either side of the guide slot, and the U-webs of the sections form the outer boundary of the hollow section and the U-legs of the sections point toward one another so that two facing U-legs define a connection section for the connection of the rail to a ceiling structure or similar structure, and two facing U-legs border the guide slot, characterized by the fact that a web 11 and a U-leg 13 of a U-section 10 that is associated with the web 11, which U-leg 13 borders the guide slot 9, is detachably connected with the guide rail 1 over a portion of the length of said guide rail 1.

Another feature of the invention resides broadly in the guide rail characterized by the fact that the two facing U-legs that form a connection section 14 for the connection of the guide rail 1 to a ceiling structure or similar structure are connected to one another in one piece.

Yet another feature of the invention resides broadly in the guide rail characterized by the fact that the web 11 of the U-section 10 has undercut grooves 16 on the outside surface 15 of the web.

Still another feature of the invention resides broadly in the guide rail characterized by the fact that the web 11 of the U-section 10 has a plurality of undercut grooves 19 extending over the height of the web.

A further feature of the invention resides broadly in the guide rail characterized by the fact that the web 11 with its associated U-legs 13 that border the guide slot 9, which web 11 can be detached over a partial length of the guide rail 1, forms the hatch (inspection piece 17) of an inspection opening 18.

Another feature of the invention resides broadly in the guide rail characterized by the fact that at least two inspection openings 18 are oriented over the length of the guide rail 1 in mirror symmetry to one another, and are offset from one another in the longitudinal direction of the guide rail 1.

Yet another feature of the invention resides broadly in the guide rail characterized by the fact that the inspection piece 17 is detachably connected with the web 11 of the adjacent U-section by means of an outer tab 19 that is in contact with the outer web surface 15 of the inspection piece 17 and the outer web surface 15 of the adjacent U-section 10.

Still another feature of the invention resides broadly in the guide rail characterized by the fact that the detachable connection is made by screws 20 that extend through the outer tab 19 and are engaged in inner tabs 21 located in the undercut grooves 16 of the web 11 of the inspection piece 17 and of the web 11 of the adjacent U-section.

A further feature of the invention resides broadly in the guide rail characterized by the fact that the detachable connection is made by hammer-head bolts that extend through the outer tab 19 and are mounted with their heads in the undercut grooves 16 of the web 11 of the inspection piece 17 and of the web 11 of the adjacent U-section 10.

Another feature of the invention resides broadly in the guide rail characterized by the fact that the facing U-legs 13 that border the guide slot 9 and form a bearing surface 22 for a support roller 3 have wear plates 23 or wear inserts in the vicinity of the bearing surface 22, and the butt joints S' of the wear inserts of the wear inserts are offset with respect to the butt joints S between the U-legs 13 of the inspection piece 17 and the U-legs 13 of the adjacent U-section 10.

Yet another feature of the invention resides broadly in the guide rail characterized by the fact that the wear plates 23 or wear inserts of the U-leg 13 adjacent to the inspection piece 17 project beyond the butt joint S of the U-leg 13.

An example of a movable partition system with a drive gear mechanism which may be utilized or incorporated in an embodiment of the present invention may be found in U.S. application Ser. No. 09/225,770, filed on Jan. 5, 1999, having attorney Docket No. NHL-DOR-51 US, and having inventors Bischof and Rechsteiner.

Another example of a movable partition system may also be found in the "HSW-G Installation Instructions," a publication produced by Dorma GmBH+Co. KG, Postfach 40 09, D-58247 Ennepetal, Federal Republic of Germany, which is hereby incorporated by reference as if set forth in its entirety herein.

Some examples of foldable doors and mechanisms and devices for their operation which may be utilized or incorporated in an embodiment of the present invention may be found in the following U.S. patents: U.S. Pat. No. 5,186,230, issued to inventor Ostrander on Feb. 16, 1993; U.S. Pat. No. 4,932,455, issued to inventor Yamada on Jun. 12, 1990; and U.S. Pat. No. 5,099,903, issued to inventor Chen on Mar. 31, 1992.

Some examples of movable partition or wall systems and devices for their operation which may be utilized or incorporated in an embodiment of the present invention may be found in the following U.S. patents: U.S. Pat. No. 5,329,857, issued to inventor Owens on Jul. 19, 1994; U.S. Pat. No. 5,295,281, issued to inventor Kordes on Mar. 22, 1994; U.S. Pat. No. 5,394,648, issued to inventor Kordes on Mar. 7, 1995; U.S. Pat. No. 5,417,013, issued to inventor Tillman on May 23, 1995; U.S. Pat. No. 5,544,462, issued to inventor Kordes on Aug. 13, 1996; U.S. Pat. No. 5,406,761, issued to inventors Hobbiebrunken, et al. on Apr. 18, 1995; U.S. Pat.

No. 5,152,332, issued to inventor Siener on Oct. 6, 1992; U.S. Pat. No. 5,042,555, issued to inventor Owens on Aug. 27, 1991; U.S. Pat. No. 4,934,119, issued to inventor Ybarra on Jun. 19, 1990; U.S. Pat. No. 4,914,878, issued to inventors Tamaki, et al. on Apr. 10, 1990; U.S. Pat. No. 4,895,246, issued to inventor Rizzi on Jan. 23, 1990; U.S. Pat. No. 4,752,987, issued to inventors Dreyer, et al. on Jun. 28, 1988; U.S. Pat. No. 4,596,094, issued to inventors Teller, et al. on Jun. 24, 1986; U.S. Pat. No. 4,555,828, issued to inventor Matimura on Dec. 3, 1985; U.S. Pat. No. 4,458,462, issued to inventor Schold on Jul. 10, 1984; U.S. Pat. No. 4,404,770, issued to inventor Markus on Sep. 20, 1983; and U.S. Pat. No. 4,112,647, issued to inventor Scheid on Sep. 12, 1978.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. 197 46 208.1, filed on Oct. 20, 1997, having inventors Markus Bischof and Stefan Rechsteiner, and DE-OS 197 46 208.1 and DE-PS 197 46 208.1 and International Application No. PCT/EP98/06466, filed on Oct. 12, 1998, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

FIGS. 7, 8, 9, 10, 11, and 12 show installation steps 1–23 of the following "HSW-G Installation Instructions."

HSW-G INSTALLATION INSTRUCTIONS

With 75×72 mm runner

1 Support Structure for Runner and Installation of the Runner

The runner must be bolted over its entire length (even when used only for parking) to a properly aligned steel support structure.

When this runner is to be used for parking the panels, the steel support structure must be designed to support the total weight of all the panels.

The runner must be fastened to the support structure approximately every 300 mm in areas where the runner runs in a straight line, and approximately every 100 mm in the parking area.

Note: All profile butt joints (except for the inspection piece—See Step 8) must be provided with connector pins a so that the movable panels will travel smoothly through the joints.

2 Preparation on the Floor

Standard eccentric bushes are used for the locks.

A. Drill a hole 25 mm in diameter and 30 mm deep for eccentric bushes, plus holes 8 mm diameter for the dowels. Align the eccentric bush (double cam) and fasten with bolt.

B. Insert eccentric bush into the tube.

3 For the floor-mounted door closer (BTS), a recess must be created (see drawing), and covered with a stainless steel cover plate.

a. Recess for swinging end-panels b. Recess for swinging-sliding panels

4 Installation of Door Runners on the Glass Panel

The door runner consists of 2 shells that are bolted together and pushed over the glass.

After the door runners have been placed in position (taking into consideration the 4.5 mm thickness of the end covers on both sides), insert and tighten M 8 Allen screws from both sides, so that the runner is screwed firmly to the glass (Allen wrench SW=5)

The tightening torque should be 20 Nm.

The clamping of the top door runner is particularly important because of its load-bearing function.

If the structure experiences vibrations, the glass panels must be installed in the runner using silicon adhesive in addition to the clamping.

For split door runners, e.g. with a deadbolt lock, install the door runners with the auxiliary ceiling profile and clamp in place.

5 Installation of the End Panel:

Push the top swing bearing a of the end panel into the end of the runner.

Bolt the swing bearing at a distance of 67 mm (pivot from the wall) using a No. 6 Allen wrench.

Install the floor mounting (Step 6) or floor-mounted door closer (pivot 67 mm from the wall). To be able to hang the end panel, the bolt b must be screwed downward. Then install the end panel by engaging the bolt b in the top swinging bearing, and then setting the panel down onto the floor mounting or the floor-mounted door closer (Figure II).

Following installation, tighten the bolt b to the bottom edge of the dowel pin f, then reverse it to a clearance of 1 mm. Then tighten nut d using a No. 17 open-end wrench. Then tighten the threaded stud in the suspension block c using a No. 5 Allen wrench.

Fasten the safety plate e using screw g to the top swinging bearing.

6 Lower floor bearing for swinging end panel. Dimension 63 can be corrected by adjusting the floor mounting a.

Loosen the fastening screws b. Move the floor mounting and retighten the screws. The height is adjusted using the enclosed shims c (3 each, each 1 mm thick).

7 Swinging end panel with ceiling-mounted door closer TS 73.

Attach the closer a as indicated in the enclosed installation instructions. Make sure the dimension of 205 mm is correct.

8 The inspection piece b can be unscrewed when defective rollers require replacement. The guide bracket c must always be screwed on.

9 Arrangement of the rollers:

Only one model of roller is provided for all panels.

The arrangement of the guide rollers is of decisive importance at the entrance to the parking area.

A Roller straight continuous=high guide roller a outside.

B Roller in zig-zag or offset location=high guide roller a inside, on railyard side.

10 Hanging the panels:

Insert the rollers with suspension blocks a of all the panels in the runner. Pay attention to the orientation described in No. 9 above.

Now set the panels on 8 mm spacer blocks on the floor under the runner, and insert the left and right suspension blocks into the load-bearing profile c (See f in the figure). The threaded studs must point outward (Step 11-c).

Adjusting the Panel Height:

Adjust the height of the panels so that on the bottom, there is 10 mm clearance (without the ceiling profile) between the floor and the base profile.

Make certain the upper dimension is 33±5.

If there is more than 38 mm, reduce the distance of 20 mm the glass is inserted in the bottom runner (lower the bottom door runner).

To adjust the height, loosen the nut d and set the height using nut e (No. 17 open-end wrench).

Turn to the left=more ground clearance

Turn to the right=less ground clearance

11 Tighten nut b slightly, move the panels into the parking area, loosen nut b and align the panels in the parking area. Retighten the nuts and fix in place using lock nuts with threaded stud M 10 c (No. 5 Allen wrench). From this point on, the height can only be adjusted using nut a.

12 Installation clearances with 5 Panels

F1=Rotating end panel with TS (Door closer) 73

F2=Sliding panel

F3=Rotating-sliding panel with TS 92

F4=Swinging-sliding panel with BTS (floor-mounted door closer)

F5=Swinging-sliding panel with RTS 85 (frame-mounted door closer)

Lateral alignment of the panels:

Align the end panel F1 with 4 mm clearance from the wall (same as in No. 5, using nut d). Slide the last panel F5 into the end position. Measure the space between panels F1 and F5. (As in this example, there must be 5×panel width+6×4 mm clearance). Then tighten the end covers and install the ceiling profiles.

13 Connections of the Individual Panel Models

Sliding panel to sliding panel

Swinging-sliding panel to swinging-sliding panel

Sliding panel to swinging-sliding panel

Rotating end panel to swinging-sliding panel

Rotating end panel to sliding panel

14 Installation of the Locking Unit

The top part a is supplied already screwed to the runner. The middle part b and the bottom part c are also supplied already mounted on the compensation plate or on the top door rail. Determine whether the set screw d can be easily screwed into the top part a. If not, loosen the screw e and adjust the top part. (Movement ±15 possible). The dimension f must be 3.5 mm for the rotating-sliding panel, and 4.5 mm for the swinging-sliding panel. Make certain that the distance between the middle and bottom part of the interlock is no more than 2.5 mm. If not, loosen screw g and adjust the bottom part. Then insert the plugs. If necessary, e.g. when the rotating-sliding panel is used with Door Closer TS 92, a stop can also be screwed onto the bottom part of the lock. On rotating end panels, end cover with stop.

15 Push the enclosed template under the panel, and place it over the respective positions for the end locking pin a, the front locking pin b or the dead-bolt c on the outer edge d of the panel. Open the panel and swing it out of the way, trace and drill the holes. Then install the strike plate or bush. (Can be moved for exact positioning ±4 or ±2.5 mm). Then close the panel and lock. Then move the next panel (F3 and F4) (Step 9), and set to 4 mm clearance. (When a floor-mounted door closer is used, adjust so that the adapter just touches the door-closer shaft. The panels must be raised 1.5 mm when the adapter is inserted).

16 Adjustable strike panel on rotating-sliding panels with TS 92 door-closer and swinging-sliding panel with RTS 85 with plastic bushing for mounting.

Drill a hole for the strike panel bush 25 mm in diameter at least 15 mm deep, 65 mm (for locking pins) and 98.5 mm (for dead bolt locks) from the outside edge of the door. Also drill 8 mm holes for dowels at a distance of 55 mm.

17 Adjustable eccentric bush (standard model) with plastic inner sleeve for all locking pins, deadbolts and mountings.

Drill a hole for the eccentric bush 25 mm in diameter at least 30 mm deep, 65 mm (for locking pins) and 98.5 mm (for deadbolts) from the outside edge of the door. Also drill 8 mm holes for dowels at a distance of 55 mm.

18 Installation of the Swinging-Sliding Panel with RTS 85 Frame-Mounted Door-Closer Hang the RTS 85 door closer (screwed into the frame-mounted door closer profile) in the RTS shaft receptacle a of the No. 56 runner b, and clamp in place with clamping plate c. The straight pin can be prevented from tipping in the clamping plate by tightening it alternately on both sides.

Then snap on the cover profile d.

19 Insert the upper brush profile a in the top compensating profile b. Adjust it so that the brush is in contact with the runner profile c and fix in position with a plastic wedge d on both sides.

20 Sequence of Operations:

on rotating-sliding panel with TS 92 ceiling-mounted door closer, and on swinging-sliding panel with RTS 85

I To switch from rotating/swinging to sliding

A Screw the locking screw into the lock middle part to the threaded stop

B Push the front locking pin knob B upward

C Unscrew the set screw from the lock top part.

II To switch from sliding to rotating

C Screw the set screw all the way into the lock top part

B Lock the front locking pin in the strike plate

A Loosen the locking screw

If, during procedure II, A is accidentally done first, the panel will slump and must be lifted up again.

Then proceed as above.

21 Sequence of Operations:

on swinging-sliding panels with BTS (floor-mounted door-closer) adapter

I To switch from swinging to sliding:

A Screw the locking screw A into the lock center part until it stops

B Remove the panel from the closer

C Loosen set screw C

II To switch from sliding to swinging:

C Screw in set strew C until it stops

B Connect panel with closer

A Loosen locking screw

Figure a: Detach from floor-mounted door closer (to slide)

Figure b: Attach to floor-mounted door closer (to swing)

If, during the operational changeover described in II above, A has been accidentally done first, the panel slumps and must be lifted up again. Then proceed as above.

22 Servicing the System and Sliding the Panels

To guarantee correct operation, please note the following service requirements:

1. Keep the locks and locking pins accessible.
2. Keep the recesses in the floor for locks and locking pins clean.

Pushing the panels

When closing the system, each panel, once positioned, must be locked before the next one follows.

The panels can be pushed very easily. Please do not apply excessive force.

Always push the panels with one hand, to keep them moving smoothly.

The panels can be either pushed or pulled see drawing.

Enter the rail yard at an angle.

23 Switching the Floor-Mounted Door Closer (BTS) Adapter (For repairs only—the DIN direction is already installed when the system is delivered)

1. Set lever a in the horizontal position (as shown), using a No. 3 Allen wrench. Loosen the threaded stud b (concealed by yoke c) through the sight hole d (2–3 turns) and extract the lever.
2. Re-insert the lever from the opposite side in the horizontal position into the shaft hole. Insert the shaft stub e until it contacts the wall f and re-tighten the threaded stud through the sight hole.

g=right, h=left, i=No. 3 Allen wrench.

AT LEAST PARTIAL NOMENCLATURE

1 Guide rail
2 Carriage
3 Support roller
4 Guide rollers
5 Support element
6 Drive pinion
7 Toothed rack
8 Box-shaped hollow section
9 Guide slot
10 U-section
11 U-web
12 U-leg
13 U-leg
14 Connection section
15 Outer surface of web
16 Undercut grooves
17 Inspection piece
18 Inspection opening
19 Outer tab
20 Screws
21 Inner tab
22 Bearing surface
23 Wear plates
S' Butt joint of the wear plates
S Butt joint of the U-leg

What is claimed is:

1. A movable partition system, which movable partition system comprising:

a guide rail being configured to be connected to a ceiling structure;

a partition carriage;

said partition carriage being configured and disposed to be movable in and along said guide rail;

at least one partition element;

said at least one partition element being suspended from said partition carriage;

said at least one partition element being configured and disposed to be moved by said partition carriage;

said guide rail having a substantially box-shaped section;

said box-shaped section comprising a guide slot;

said partition carriage comprising a support element, which support element forming the connection between said partition carriage and said at least one partition element;

said guide slot being configured and disposed to permit said support element to pass through said guide slot;

said box-shaped section comprising a first U-shaped section and a second U-shaped section, which U-shaped sections are configured and disposed to face one another in a substantially symmetrical position on either side of said guide slot;

each of said U-shaped sections comprising:

a first U-leg;

a second U-leg;

each of said U-legs being disposed to face one another;

a U-web;

said U-web being disposed substantially transverse to each of said U-legs;

said U-web being configured and disposed to form the connection between said first U-leg and said second U-leg;

said first U-leg of said first U-shaped section and said first U-leg of said second U-shaped section being disposed substantially symmetrically on either side of said guide slot;

said U-web of said first U-shaped section being disposed to face opposite said U-web of said second U-shaped section;

said second U-leg of said first U-shaped section and said second U-leg of said second U-shaped section being disposed substantially symmetrically to together form a connecting section, which connecting section being configured to connect said guide rail to a ceiling structure; and said first U-leg and said U-web of said first U-shaped section being configured and disposed together to form a detachable portion, which detachable portion is detachably connected over a portion of the length of said guide rail.

2. The movable partition system according to claim 1, wherein said second U-leg of said first U-shaped section and said second U-leg of said second U-shaped section are connected together to form a single structure.

3. The movable partition system according to claim 2, wherein:

said U-web comprises an inside surface and an outside surface;

said inside surface is disposed within said guide rail;

said outside surface is disposed on the exterior of said guide rail; and said outside surface comprises undercut grooves.

4. The movable partition system according to claim 3, wherein:

said detachable portion further comprises an attachment structure configured and disposed to attach said detachable portion to said guide rail; and said attachment structure being configured and disposed to extend over the heigth of said outside surface of said U-web of said detachable portion.

5. The movable partition system according to claim 4, wherein:

said guide rail comprises at least one inspection opening; and said detachable portion comprises at least one hatch piece, which hatch piece is configured and disposed to cover said at least one inspection opening.

6. The movable partition system according to claim 5, wherein:

said guide rail comprises at least two inspection openings;

at least two of said at least two inspection openings are disposed substantially symmetrically over the length of the guide rail; and said at least two of said at least two inspection openings are disposed offset from one another in the longitudinal direction of the guide rail.

7. A method for and installing and using a guide rail of a movable partition system, which movable partition system comprising a guide rail being configured to be connected to a ceiling structure; a partition carriage; said partition carriage being configured and disposed to be movable in and along said guide rail; at least one partition element; said at least one partition element being suspended from said partition carriage; said at least one partition element being configured and disposed to be moved by said partition carriage; said guide rail having a substantially box-shaped section; said box-shaped section comprising a guide slot; said partition carriage comprising a support element, which support element forming the connection between said partition carriage and said at least one partition element; said guide slot being configured and disposed to permit said support element to pass through said guide slot; said box-shaped section comprising a first U-shaped section and a second U-shaped section, which U-shaped sections are configured and disposed to face one another in a substantially symmetrical position on either side of said guide slot; each of said U-shaped sections comprising: a first U-leg; a second U-leg; each of said U-legs being disposed to face one another; a U-web; said U-web being disposed substantially transverse to each of said U-legs; said U-web being configured and disposed to form the connection between said first U-leg and said second U-leg; said first U-leg of said first U-shaped section and said first U-leg of said second U-shaped section being disposed substantially symmetrically on either side of said guide slot; said U-web of said first U-shaped section being disposed to face opposite said U-web of said second U-shaped section; said second U-leg of said first U-shaped section and said second U-leg of said second U-shaped section being disposed substantially symmetrically to together form a connecting section, which connecting section being configured to connect said guide rail to a ceiling structure; and said first U-leg and said U-web of said first U-shaped section being configured and disposed together to form a detachable portion, which detachable portion is detachably connected over a portion of the length of said guide rail; said method comprising the steps of:

attaching said detachable portion to an opening in a portion of the length of said guide rail;

detaching said detachable portion from a portion of the length of said guide rail to open an opening in said guide rail;

inspecting said carriage of said movable partition system through said opening; and reattaching said detachable portion to said guide rail upon completion of inspection.

8. Guide rail for a movable partition system having a partition carriage with a suspended partition that is suspended from the partition carriage, said guide rail comprising:

a substantially box-shaped section;

said box-shaped section comprising a guide slot;

said guide slot being configured to permit passage of a support element of a partition carriage through said guide slot;

said box-shaped section comprising a first U-shaped section and a second U-shaped section, which U-shaped sections are configured and disposed to face one another in a substantially symmetrical position on either side of said guide slot;

each of said U-shaped sections comprising:

a first U-leg;

a second U-leg;

each of said U-legs being disposed to face one another;

a U-web;

said U-web being disposed substantially transverse to each of said U-legs;

said U-web being configured and disposed to form the connection between said first U-leg and said second U-leg;

said first U-leg of said first U-shaped section and said first U-leg of said second U-shaped section being configured to be disposed substantially symmetrically on either side of said guide slot;

said U-web of said first U-shaped section being configured to be disposed to face opposite said U-web of said second U-shaped section;

said second U-leg of said first U-shaped section and said second U-leg of said second U-shaped section being configured to be disposed substantially symmetrically together to form a connecting section, which connecting section being configured to connect said guide rail to a ceiling structure; and said first U-leg and said U-web of said first U-shaped section being configured and disposed to together form a detachable portion, which detachable portion is configured to be detachably connected over a portion of the length of said guide rail.

9. The guide rail according to claim 8, wherein said second U-leg of said first U-shaped section and said second U-leg of said second U-shaped section are connected together to form a single structure.

10. The guide rail according to claim 9, wherein:

said U-web comprises an inside surface and an outside surface;

said inside surface is disposed within said guide rail;

said outside surface is disposed on the exterior of said guide rail; and said outside surface comprises undercut grooves.

11. The guide rail according to claim 10, wherein;

said detachable portion further comprises an attachment structure configured and disposed to attach said detachable portion to said guide rail; and said attachment structure being configured and disposed to extend over the heigth of said outside surface of said U-web of said detachable portion.

12. The guide rail according to claim 11, wherein:

said guide rail comprises at least one inspection opening; and said detachable portion comprises at least one hatch piece, which hatch piece is configured and disposed to cover said at least one inspection opening.

13. The guide rail according to claim 12, wherein:

said guide rail comprises at least two inspection openings;

at least two of said at least two inspection openings are disposed substantially symmetrically over the length of the guide rail; and said at least two of said at least two inspection openings are disposed offset from one another in the longitudinal direction of the guide rail.

14. Guide rail according to claim 13, wherein said attachment structure is configured to be detachably connected to said U-web.

15. Guide rail according to claim 14, wherein:

said outer surface of said U-web comprises projections;

said attachment structure comprises screws;

said attachment structure comprises openings; and said screws are configured to be screwed through said openings to engage with said projections to form the detachable connection between said attachment structure and said U-web.

16. Guide rail according to claim 15, wherein:

said first U-leg further comprises a bearing structure, which bearing structure is configured to support a support roller of a partition carriage;

said bearing structure comprises one of:

a) a wear insert; or b) a wear plate;

said bearing structure comprises butt joints;

said first U-leg comprises butt joints; and said butt joints of said bearing structure are offset with respect to said butt joints of said first U-leg.

17. Guide rail according to claim 16, wherein:

said butt joints of said bearing structure project beyond said butt joints of the first U-leg into said inspection opening.

18. Guide rail according to claim 14, wherein:

said attachment structure comprises hammerhead bolts, which hammerhead bolts comprise heads;

said outer surface of said U-web comprises projections;

said attachment structure comprises openings;

said hammerhead bolts are configured to be passed through said openings; and said heads of said hammerhead bolts being configured to engage with said projections to form the detachable connection between said attachment structure and said U-web.

19. The guide rail according to claim 8, wherein:

said U-web comprises an inside surface and an outside surface;

said inside surface is disposed within said guide rail;

said outside surface is disposed on the exterior of said guide rail; and said outside surface comprises undercut grooves.

20. The guide rail according to claim 8, wherein:

said guide rail comprises at least one inspection opening; and said detachable portion comprises at least one hatch piece, which hatch piece is configured and disposed to cover said at least one inspection opening.

* * * * *